US005578776A

United States Patent [19]

Valtchev

[11] Patent Number: 5,578,776

[45] **Date of Patent: *Nov. 26, 1996**

[54] CLARINET MOUTHPIECE GRASPING RIG

[76] Inventor: Konstantin L. Valtchev, 43 Cosmic Drive, North York, Ontario, Canada, M3B 3G11

[ * ] Notice: The term of this patent shall not extend beyond the expiration date of Pat. No. 5,440,962.

[21] Appl. No.: 512,360

[22] Filed: Aug. 8, 1995

Related U.S. Application Data

[63] Continuation-in-part of Ser. No. 248,914, May 25, 1994, Pat. No. 5,440,962.

[51] Int. Cl.[6] ..... G10D 9/02

[52] U.S. Cl. ..... 84/383 R

[58] Field of Search ..... 84/383 A, 383 R, 84/398

[56] References Cited

U.S. PATENT DOCUMENTS 2,138,500 10/1936 Miessner ..... 84/383

2,527,988 3/1948 Dillon ..... 84/383

*Primary Examiner*—Patrick J. Stanzione

*Attorney, Agent, or Firm*—Henderson & Sturm

[57] ABSTRACT

A clarinet ligature and grasping ring device (10) for use with a mouthpiece/reed assembly (100) wherein the device (10) includes a ligature unit (11) having a reed clamp member (20) and a pair of spring support members (30) operatively joined together in a surrounding relationship with the mouthpiece member (101) of the assembly (100) by an elongated spring member (40); and, a grasping ring unit (12) fixedly secured to the mouthpiece member (101) so that the mouthpiece member (101) may be removed from the clarinet barrel member (106) without disturbing the engagement between the ligature unit (11) with the mouthpiece (101).

8 Claims, 2 Drawing Sheets

CLARINET MOUTHPIECE GRASPING RIG

This is a continuation-in-part of U.S. patent application Ser. No. 08/248,914 filed on May 25, 1994 and entitled "Clarinet Ligature and Grasping Ring" now U.S. Pat. No. 5,440,962.

TECHNICAL FIELD

The present invention relates to the field of ligatures for musical instruments in general, and in particular to a new type of clarinet ligature and grasping ring.

BACKGROUND ART

As can be seen by reference to the following U.S. Pat. Nos. 5,000,073; 4,991,483; 3,202,032; and 2,837,003; the prior art is replete with a myriad and diverse mouthpiece and ligature constructions for musical reed instruments.

While all of the aforementioned prior art constructions are more than adequate for the basic purpose and function for which they have been specifically designed, these patented arrangements do no represent the ultimate design for this type of a device, and as will be explained further on in greater details there is ample room for improvement in this area of technology.

In addition none of the prior art devices contemplate the use of a grasping ring in combination with the ligature and the present invention specifically addresses that particular oversight.

As a consequence of the foregoing situation, there has existed a longstanding need among musicians who play reed instruments for a new type of clarinet ligature and grasping ring which will not only improve the performance of the musical instrument but will permit the musician to remove the mouthpiece without disturbing the ligature; and, the provision of such a construction is a stated objective of the present invention.

DISCLOSURE OF THE INVENTION

Briefly stated, the clarinet ligature and grasping ring device that forms the basis of the present invention comprises in general a grasping ring unit adapted to be secured to the mouthpiece portion of the clarinet mouthpiece assembly, and a ligature unit adapted to engage the clarinet reed.

In addition the ligature unit comprises a reed clamp member and a pair of spring support members which are joined to one another in a surrounding relationship relative to the clarinet mouthpiece assembly by an elongated spring member which is releasably joined together on its opposite ends.

As will be explained in greater detail further on in the specification, the grasping ring unit permits easy removal of the mouthpiece from the barrel of the clarinet without disturbing the ligature. Furthermore the ligature unit possess the following advantages over the prior art. It permits easy vibration of the reed which makes the tone more focused and amplifies the sound. The reed is more sensitive to lip pressure, and sharpening or flattening of the tone can be achieved on a larger scale. The musician can change from the upper to lower register and vice versa very easily and, the reed can be changed very easily by displacing the reed clamp from the reed, pulling the old reed and replacing a new reed, followed by a release of the reed clamp.

BRIEF DESCRIPTION OF THE DRAWINGS

These and other attributes of the invention will become more clear upon a thorough study of the following description of the best mode for carrying out the invention, particularly when reviewed in conjunction with the drawings, wherein.

BEST MODE FOR CARRYING OUT THE INVENTION

Figure 1:
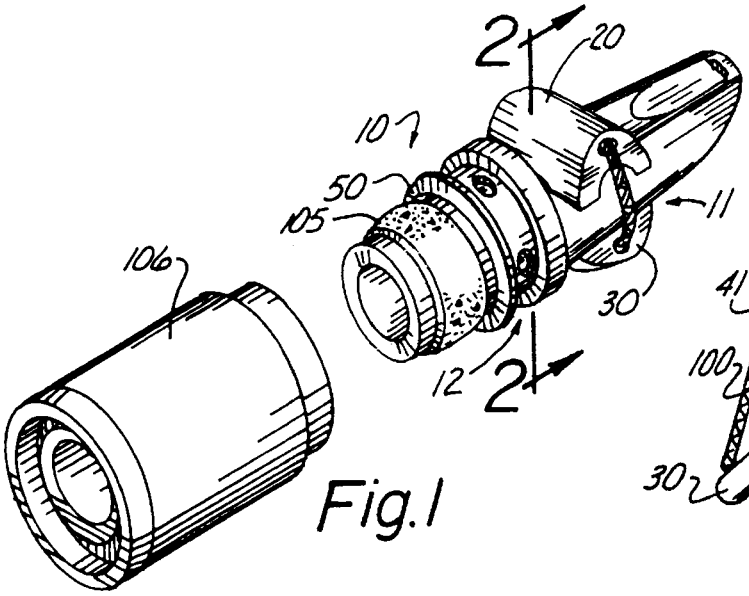
FIG. 1 is a perspective view of the clarinet ligature and grasping ring device that forms the basis of this invention employed on a clarinet mouthpiece assembly.

As can be seen by reference to the drawings, and in particular to FIG. 1, the clarinet ligature and grasping ring device that forms the basis of the present invention is designated generally by the reference numeral (10). The device (10) comprises in general a ligature unit (11) and a grasping ring unit (12) adapted to engage a clarinet mouthpiece reed assembly designated generally as (100). These units will now be described in seriatim fashion.

Before embarking on a detailed description of the ligature unit (11) and grasping unit (12) it would first be advisable to briefly discuss the mouthpiece/reed assembly (100) which the aforementioned units were developed for use in conjunction with.

As can best be appreciated by reference to FIGS. 1 through 4, the mouthpiece/reed assembly (100) comprises a mouthpiece member (101) having a distal end (102) which is filled with a replaceable reed element (103); and a proximal end (104) which terminates in a reduced neck portion (105) which is dimensioned to slideably receive a conventional clarinet barrel member (106).

As shown in FIGS. 1 through 5 and 7, the ligature unit (11) comprises a reed clamp member (20) a pair of spring support members (30) and an elongated spring member (40). The reed clamp member (20) comprises an elongated hollow body (21) having an enlarged generally semi-circular recess (22) formed along its longitudinal axis and a generally shallow transverse recess (23) which has the curvature of the reed disposed generally perpendicular to the longitudinally aligned recess (22) such that the recesses (22)(23) have a cruciform configuration. In addition the reed clamp body (21) is further provided with a discrete bore (24) which is formed proximate the apex of the arched body (21).

Figure 5:
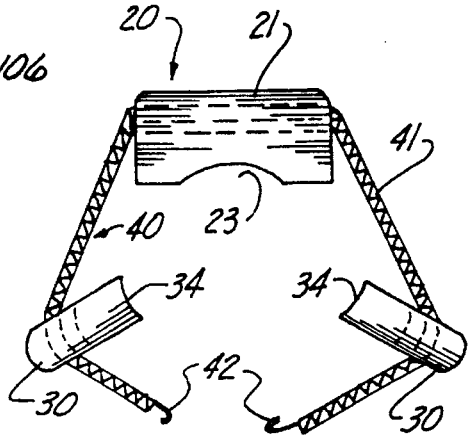
FIG. 5 is an isolated end view of the device prior to engagement with the mouthpiece.
Figure 6:
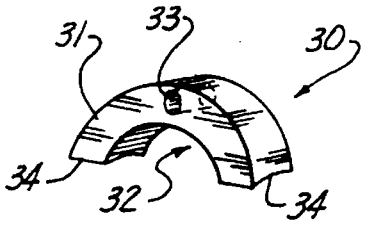
FIG. 6 is an isolated perspective view of one of the spring supporters.
Figure 7:
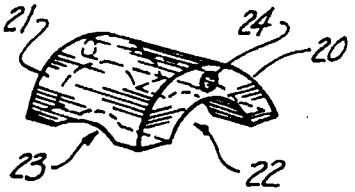
FIG. 7 is an isolated perspective view of the reed clamp.

Turning now to FIGS. 5 and 6, it can be seen that each of the spring support members (30) comprises a slim profile arched body (31) having a semi-circular central recess (32) formed therein and a discrete aperture (33) formed proximate the apex of the arched body (31). In addition the opposite ends (34) of the arched body (31) are curved to conform to the periphery of the clarinet mouthpiece (101) as shown in FIG. 2.

Figure 2:
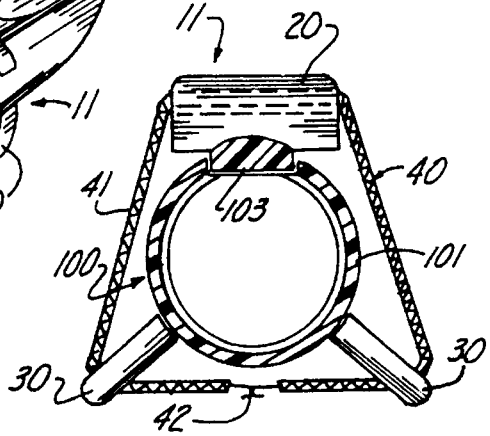
FIG. 2 is a cross-sectional view taken through line 2—2 of FIG. 1.

As can best be seen by reference to FIG. 5, the spring member (40) comprises an elongated spring body (41) dimensioned to be threaded through the elongated bore (24) in the reed clamp member (20) and the discrete apertures (33) in the spring support members (30); wherein, the opposite ends of the spring body (41) are provided with hook elements (42) which are designed to engage one another as illustrated in FIG. 2, for the purpose of engaging the ligature unit (11) to the mouthpiece.

Figure 3:
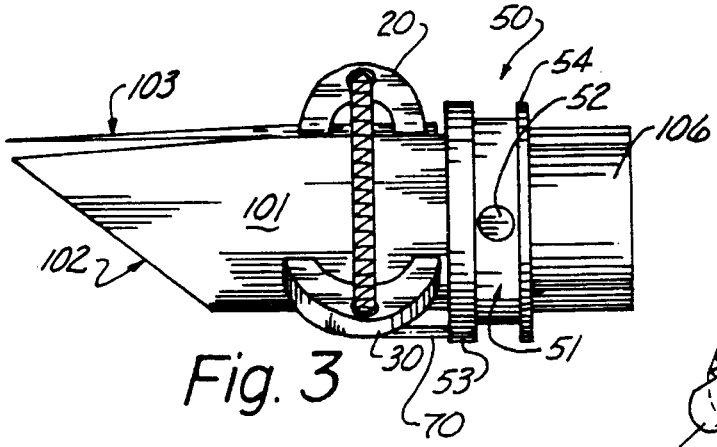
FIG. 3 is a side view of the device installed on the clarinet mouthpiece assembly.
Figure 4:
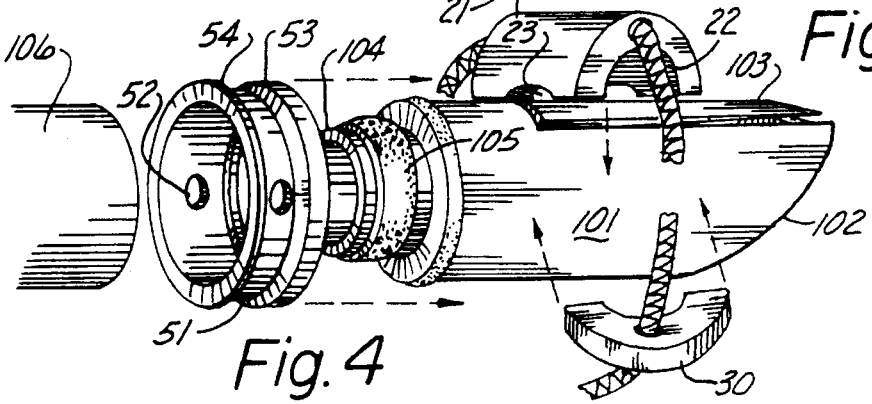
FIG. 4 is a partially exploded perspective view of the arrangement depicted in FIG. 3.

Turning now to FIGS. 1, 3 and 4, it can be seen that the grasping ring unit (12) comprises a generally short hollow cylindrical grasping ring member (50) having a relatively short and generally truncated hollow cylindrical configuration; wherein, the grasping ring member (50) is provided with a peripheral recess (51) provided with a plurality of apertures (52) disposed at spaced locations around the peripheral recess; wherein the distal end (53) of the grasping ring member (50) defines a relatively thick lip portion and the proximal end (54) of the grasping ring member (50) defines a relatively thin lip portion.

Figure 8:
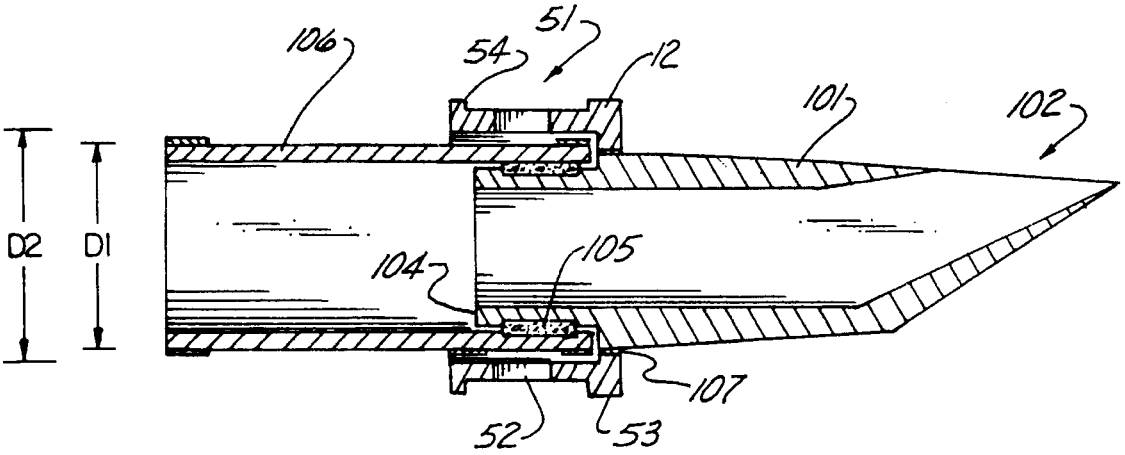
FIG. 8 is an isolated cross sectional view of the operational engagement between the clarinet barrel, the mouthpiece member and the grasping ring.

In addition, as shown in FIG. 8, the width of the recess (51) is dimensioned to accommodate the width of the users finger and the distal end (53) is thicker than the proximal end (54) of the grasping ring member (50) to both provide an enlarged bearing surface for the application of force to remove the mouthpiece member (101) from the clarinet, as well as to provide an enlarged surface area for the adhesive bonding (107) between the grasping ring member (50) and the mouthpiece member (101).

Still referring to FIG. 8, it can be seen that the distal end (53) of the grasping ring member (50) has an inside diameter D1 that is less than the inside diameter D2; wherein, the smaller distal end (102) of the generally conically shaped mouthpiece member (101) is inserted through the proximal end (54) of the grasping ring member (50) until the proximal end of the mouthpiece member (101) becomes wedged into engagement with the distal end (53) of the grasping ring member (50) to provide a very tight fit which is further enhanced by the adhesives (107).

In addition, this arrangement further insurers that there is a nominal spacing between the outer surface of the barrel member (106) and the inner surface of the grasping ring member (50) to prevent vibrations caused by the rubbing contact between these structural elements; and further allows the barrel member (106) to be inserted through the distal end (53) of the grasping ring (50) to releasably engage the mouthpiece member (101).

Furthermore, the grasping ring member (50) is dimensioned to slideably engage the mouthpiece member (101) and be fixedly secured on one end (53) thereto via adhesives or the like (107); such that the grasping ring member (50) and mouthpiece member (101) can be removed from the barrel assembly (106) as a single unit, without the need to disturb the operative engagement of the ligature unit (11) with the remainder of the mouthpiece/reed assembly (100). In this way, the mouthpiece member (101) can be attached to the barrel of another clarinet in a very short period of time, which is a crucial consideration for professional musicians.

As can also be seen by reference to FIG. 3, the grasping ring (50) may be operatively attached to one or more of the spring support members (30) by a connecting member (70).

Having thereby described the subject matter of the present invention, it should be apparent that many substitutions, modifications and variations of the invention are possible in light of the above teachings. It is therefore to be understood that the invention as taught and described herein is only to be limited to the extent of the breadth and scope of the appended claims.

I claim:

1. A grasping ring unit for use with a mouthpiece/reed assembly which includes a generally cylindrical barrel member and a generally tapered mouthpiece member having a reduced neck portion dimensioned to be operatively engaged by said barrel member; wherein, the grasping ring unit comprises:

a relatively short hollow cylindrical grasping ring member having a distal end and a proximal end and being fixedly secured on said distal end in a surrounding relationship relative to said mouthpiece member, proximate the juncture of said mouthpiece member and said barrel member.

2. The grasping ring unit as in claim 1; wherein, said grasping ring member is further provided with a peripheral recess disposed intermediate said distal and proximal end.

3. The grasping ring unit as in claim 2; wherein, said peripheral recess is provided with a plurality of apertures.

4. The grasping ring unit as in claim 3; wherein, the lip portion on the distal end of the grasping ring member is substantially thicker than the lip portion on the proximal end of the grasping ring member.

5. The grasping ring unit as in claim 2; further provided with a connector member and at least one spring support member wherein the connector member permanently secures said at least one spring support member to said grasping ring unit.

6. The grasping ring unit as in claim 1; wherein, the hollow proximal end of said grasping ring member is dimensioned to loosely surround said barrel member.

7. The grasping ring unit as in claim 6; wherein the hollow distal end of said grasping ring member is dimensioned to engage the periphery of said mouthpiece member proximate the juncture of said mouthpiece member and said barrel member.

8. The grasping ring unit as in claim 1; wherein, the hollow distal end of said grasping ring member is dimensioned to engage the periphery of said mouthpiece member.

* * * * *